United States Patent [19]

Hosoya et al.

[11] Patent Number: 4,628,860

[45] Date of Patent: Dec. 16, 1986

[54] DEVELOPING APPARATUS

[75] Inventors: Masahiro Hosoya, Yokohama; Tsutomu Uehara, Yokosuka; Shinya Tomura, Yamato, all of Japan

[73] Assignee: Kabushiki Kaisha Toshiba, Kawasaki, Japan

[21] Appl. No.: 831,092

[22] Filed: Feb. 21, 1986

Related U.S. Application Data

[63] Continuation of Ser. No. 785,038, Oct. 8, 1985, abandoned, which is a continuation-in-part of Ser. No. 655,444, Sep. 28, 1984, abandoned.

[30] Foreign Application Priority Data

Sep. 30, 1983 [JP] Japan ..... 58-182689
Sep. 30, 1983 [JP] Japan ..... 58-182743

[51] Int. Cl.[4] ..... G03G 15/06
[52] U.S. Cl. ..... 118/649
[58] Field of Search ..... 118/649

[56] References Cited

U.S. PATENT DOCUMENTS

| | | | |
|---|---|---|---|
| 3,731,146 | 5/1973 | Bettiga et al. | 317/3 |
| 4,194,830 | 3/1980 | Ohnuma | 355/3 DD |
| 4,377,332 | 3/1983 | Tamura | 355/3 DD |
| 4,378,158 | 3/1983 | Kanbe | 355/3 DD |
| 4,380,966 | 4/1983 | Isaka et al. | 118/557 X |
| 4,386,577 | 6/1983 | Hosono et al. | 118/657 |
| 4,391,891 | 7/1983 | Tamura et al. | 118/657 X |
| 4,395,110 | 7/1983 | Hosono et al. | 118/657 X |
| 4,421,057 | 12/1983 | Hosono et al. | 118/657 |
| 4,444,864 | 4/1984 | Takahashi | 118/657 X |
| 4,458,627 | 7/1984 | Hosono et al. | 118/657 |

FOREIGN PATENT DOCUMENTS

| | | |
|---|---|---|
| 0002845 | 11/1979 | European Pat. Off. . |
| 1494219 | 12/1977 | United Kingdom . |

*Primary Examiner*—Bernard D. Pianalto
*Attorney, Agent, or Firm*—Oblon, Fisher, Spivak, McClelland, & Maier

[57] ABSTRACT

A developing apparatus comprises a developing roll for carrying a nonmagnetic toner thereon, and an elastic blade pressed against the outer circumferential surface of the developing roll to apply the toner thereto. The toner is applied to the surface of the developing roll by the elastic blade to form a thin layer of the toner on the surface of the developing roll. The thin layer is opposed to a photosensitive body to deposit the toner on a latent image on the photosensitive body. The developing roll has a surface which is opposite to the photosensitive body and the whole of which is roughened.

11 Claims, 9 Drawing Figures

DEVELOPING APPARATUS

This application is a continuation of application Ser. No. 785,038, filed Oct. 8, 1985, now abandoned, which is a continuation-in-part of application Ser. No. 655,444, filed Sept. 28, 1984, abandoned.

BACKGROUND OF THE INVENTION

The present invention relates to a developing apparatus and, more particularly, to an improvement in a developing apparatus in which a latent image formed on a photosensitive body or a dielectric body is visualized by using a one-component developing agent consisting of only nonmagnetic toner in an electrophotography apparatus or an electrostatic recording apparatus.

Such developing apparatuses can be classified into apparatuses which use a two-component developing agent consisting of toner and a carrier, and apparatuses which use a one-component developing agent consisting only of magnetic toner. With recent technical advances in this field, a developing apparatus which uses a one-component developing agent consisting only of nonmagnetic toner which can resolve defects of the one-component developing agent consisting only of magnetic toner has been developed. However, such a developing apparatus has a big problem in that it is difficult to stably form a uniform thin toner layer on a surface of a movable developing agent carrier, thereby preventing the practical use of this apparatus.

In this manner, the present inventors have invented a developing apparatus shown in FIG. 1 (Japanese Patent Application No. 57-155934), and succeeded in forming a thin layer of nonmagnetic toner. In this invention, as shown in FIGS. 1 and 2, a rubber blade 2 as a flexible coating member is provided to be brought into surface contact with a developing roll 1 as a movable developing agent carrier except for a free end portion of the rubber blade, i.e., an edge portion positioned at a downstream side along the flow of the developing agent. Nonmagnetic toner 4 is fed from, for example, a toner holder 3 to a surface of the developing roll 1. The toner 4 is uniformly coated by the rubber blade 2 on the surface of the developing roll 1, thereby forming a thin toner layer. This thin toner layer is opposed to a photosensitive drum 5 as a latent image carrier, thereby developing a latent image thereon.

According to the developing apparatus described above, a contact area between a surface of the movable developing agent carrier and the flexible coating member can be set to be large. In addition, no edge portion of the flexible coating member is brought into contact with the surface of the developing agent carrier, thereby preventing a pressing force from acting on the surface thereof. As a result, nonuniformity caused by variations in setting conditions, mechanical precision, wear or the like can be moderated, thereby forming a satisfactorily uniform toner layer. Moreover, since the contact area between the surface of the carrier and the coating member is large, the developing agent is subjected to friction for a sufficiently long period of time under the pressing force when it passes through this contact portion. As a result, the developing agent can be uniformly and sufficiently charged by friction. Therefore, since the developing agent having a sufficient electric charge can be formed into a uniform thin layer, a latent image can be satisfactorily developed.

However, the present inventors found by the experiment that the above-mentioned developing apparatus has the following problems.

(1) In order to form a uniform thin toner layer, a pressing force of the rubber blade must be set to be larger than a predetermined value. Therefore, the toner layer formed on the surface of the developing roll becomes extremely thin. Microscopically, toner particles or toner aggregate is sparsely applied on the surface of the developing roll. As a result, when the toner layer is arranged to oppose a latent image carrier and then non-contact development is performed to form a developed image, the thus developed image cannot have a sufficient copy density.

(2) The nonmagnetic toner used in this apparatus must have a considerable flowability. When the toner having a poor flowability is used, a toner path under pressure of the rubber blade is clogged by the toner aggregate, and the toner cannot pass this portion. For this reason, stripes are undesirably formed in the toner layer on the surface of the developing roll.

(3) When a foreign material is mixed in the developing agent particles, this foreign material clogs the toner path under pressure of the rubber blade and the toner cannot pass this clogged portion. For this reason, stripes are undesirably formed in the toner layer on the surface of the developing roll.

The above problems (2) and (3) are mainly caused by undesirable slippage between the toner or the toner layer and the surface of the developing roll under the pressing force of the flexible coating member. This will be described with reference to FIG. 3. The toner 4 or a toner aggregate 6 is brought under the influence of the pressing force of the rubber blade 2 upon rotation of the developing roll 1 and is subjected to a blocking force F1 of the blade 2 and a feeding force F2 of the developing roll 1. Formation performance of the toner layer is determined by the shear property of the toner aggregate 6 under the forces F1 and F2. When a maximum static friction coefficient between the toner 4 and the developing roll 1 is small, the toner aggregate 6 begins to slip on the surface of the developing roll 1 before it is sheared, and collects under the rubber blade 2. The passage of further toner particles is prevented by the collected toner aggregate. As a result, stripes having no toner particles are formed on the surface of the developing roll 1. It should be noted that even if a part designated by reference numeral 6 in FIG. 3 is not the toner aggregate but a foreign material, stripes are formed in the toner layer in the same process.

The problem (1) is caused by the following behaviour of the toner particles. In the toner particles collected due to the slippage, the toner particles which are in contact with the surface of the developing roll gradually increase their frictional charge, and an electrostatic attracting force with respect to the developing roll is also increased. When the attracting force is increased, dynamic frictional force between the toner particles and the developing roll is also increased. When the frictional force reaches a predetermined value, the toner aggregate is sheared. The thus sheared toner is fed by the developing roll. In this manner, since the toner aggregate is intermittently sheared, the toner layer having a low copy density is sparsely formed on the surface of the developing roll, resulting in a low copy density of the developed image.

SUMMARY OF THE INVENTION

It is an object of the present invention to provide a developing apparatus in which a high quality image which is uniform and has sufficient copy density can be stably formed by using a one-component developing agent consisting of nonmagnetic toner.

In order to attain the above object, there is provided a developing apparatus which comprises a developing agent carrier for carrying a developing agent thereon; and an elastic member pressed against the surface of the developing agent carrier to apply the developing agent thereto, so that the developing agent is applied to the surface of the developing agent carrier by the elastic member to form a thin layer of the developing agent on the surface of the developing agent carrier, and that the thin layer is opposed to an image carrier to deposit the developing agent on a latent image on the image carrier, and is characterized in that said developing agent carrier has a surface which is opposite to the image carrier and the whole of which is roughened.

Moreover, the relationship among $\mu t$, $\mu b$, and $\mu r$ is:

$$\mu t < \mu b < \mu r$$

where the value $\mu r$ is the friction coefficient between the developing agent carrier and the non-magnetic developing agent, the value $\mu t$ is the friction coefficient between the particles of the developing agent, and the value $\mu b$ is the friction coefficient between the elastic member and the non-magnetic developing agent.

DETAILED DESCRIPTION OF THE PREFERRED EMBODIMENTS

Figure 5:
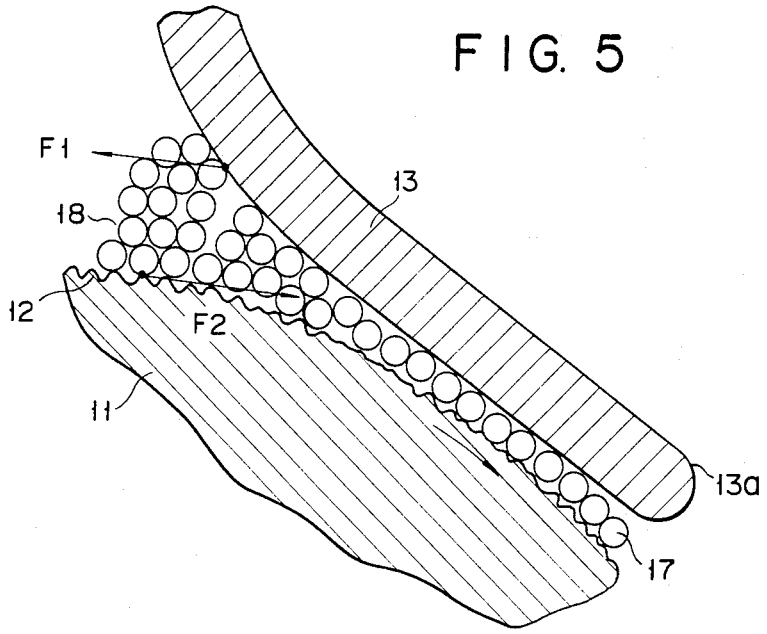
FIG. 5 is an enlarged sectional view showing a contact area between the developing roll and the elastic blade in the apparatus of FIG. 4.
Figure 6:
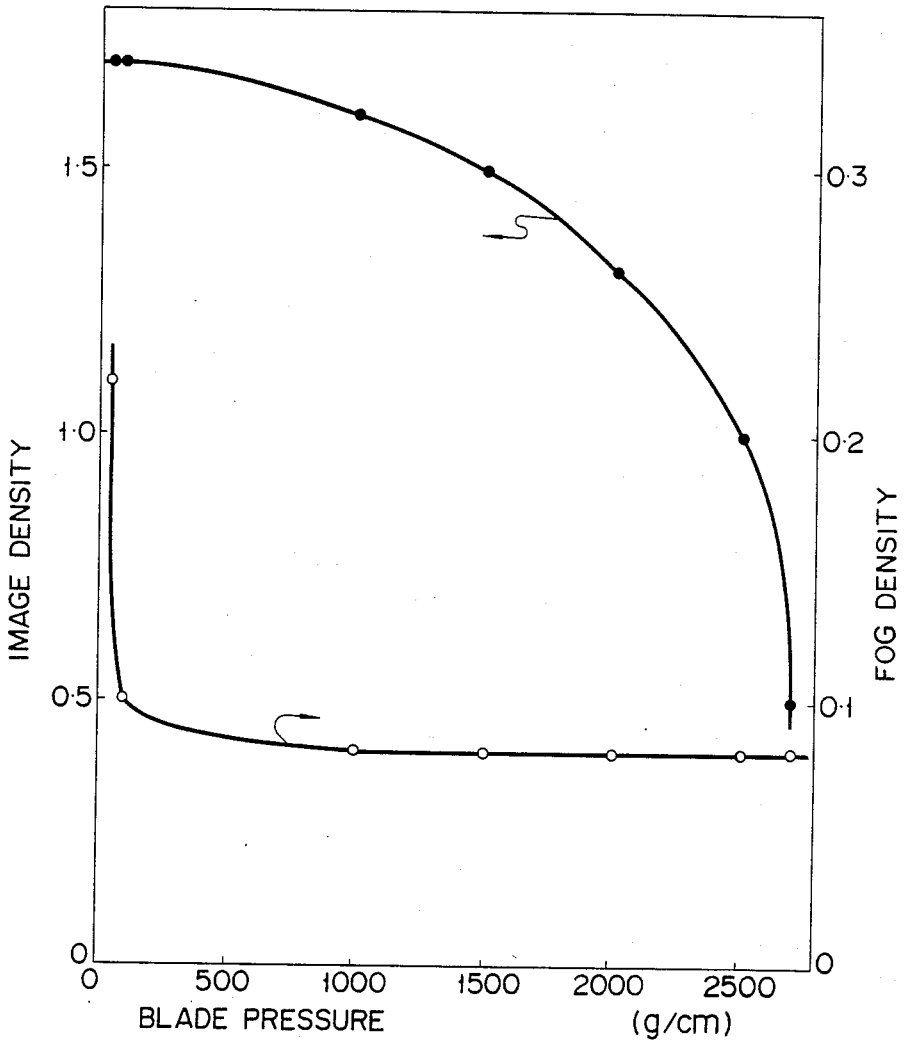
FIG. 6 is a chart showing the relationship of a blade-pressure to a copy density and to a fog density.

One embodiment of a developing apparatus according to the present invention will be described with reference to FIGS. 4 to 6 in detail hereinafter.

Figure 1:
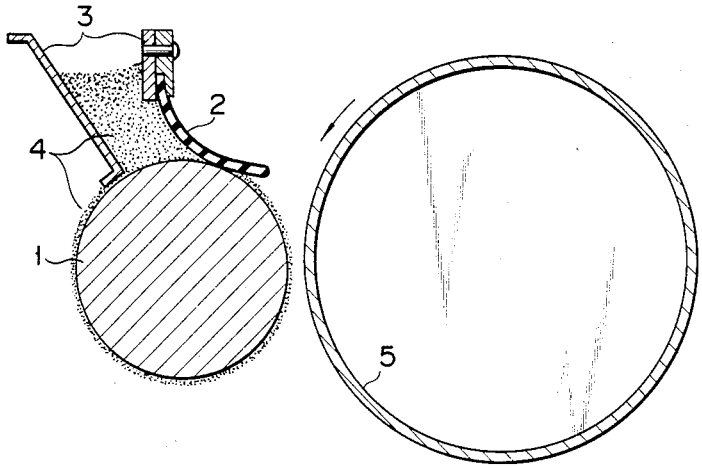
FIG. 1 PRIOR ART
FIGS. 1 and 2 are a sectional view and a perspective view, respectively, showing a prior art developing apparatus.
Figure 2:
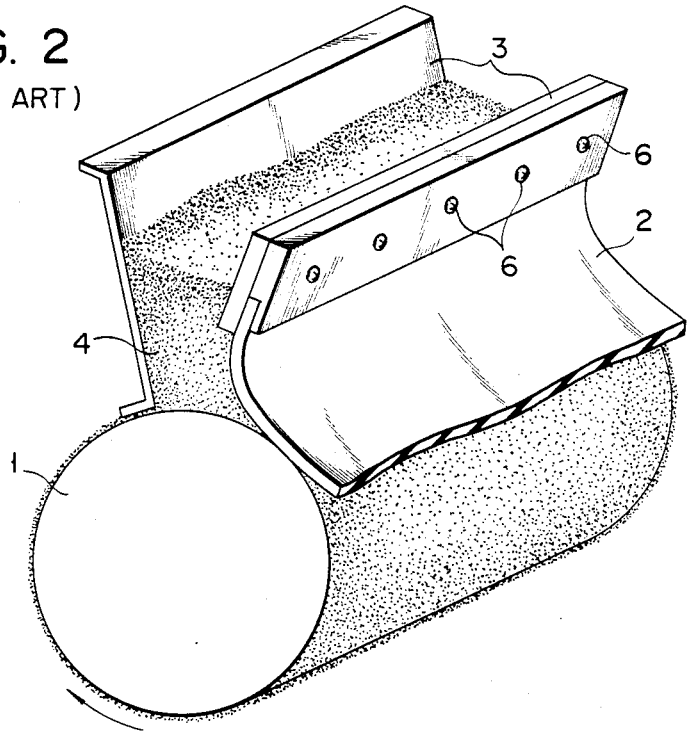
FIG. 2 (PRIOR ART)
Figure 3:
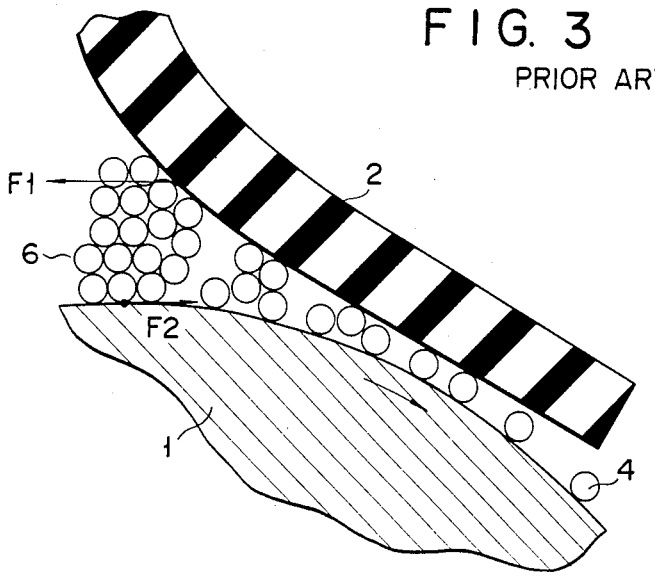
FIG. 3 PRIOR ART
FIG. 3 is an enlarged sectional view showing a contact area between the developing roll and the elastic blade in the prior art.
Figure 4:
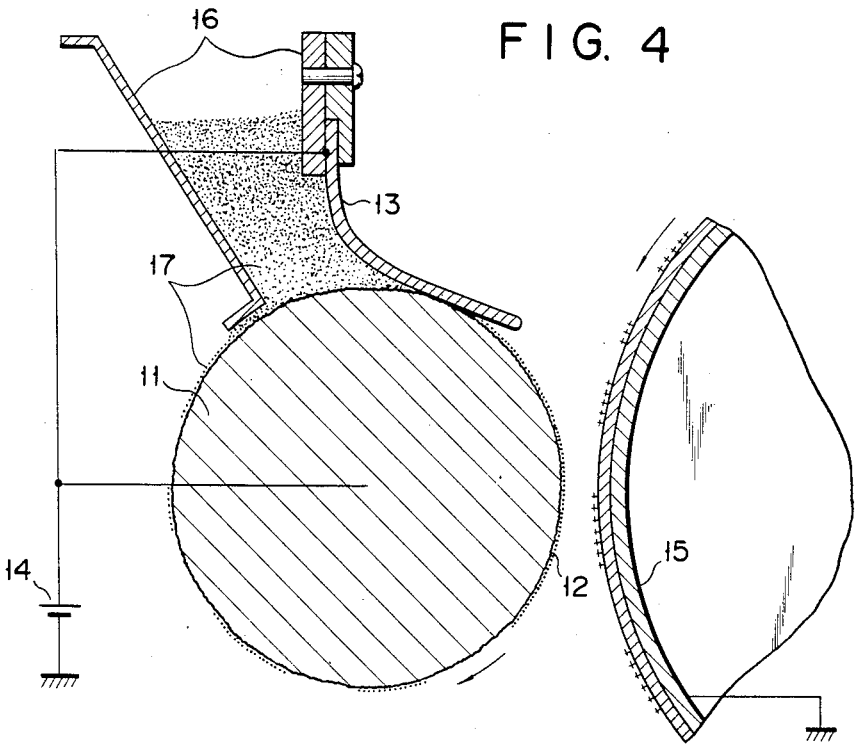
FIG. 4 is a sectional view showing a developing apparatus according to one embodiment of the present invention.

In FIG. 4, reference numeral 11 denotes a developing roll as a movable developing agent carrier which is supported to be rotatable clockwise. A roughened surface 12 is uniformly formed on a surface (outer circumferential surface) of the developing roll 11 by a sandblast treatment.

Reference numeral 13 denotes a metal plate having elasticity as a flexible coating member. An outer curved surface of the metal plate 13 is urged against the outer circumferential surface of the developing roll 11 to be brought into surface contact therewith. In other words, the free end portion of the metal plate 13, i.e., an edge portion thereof positioned at a downstream side along flow of the toner, is not brought into contact with the developing roll 11. Therefore, a surface of the metal plate 13 except for the free end portion is brought into surface contact with the outer circumferential surface of the developing roll 11. In order to obtain a uniform frictional charge and a thin toner layer of a suitable thickness, pressing force with respect to the developing roll 11 is preferably set to fall within the range between 100 g/cm to 2,500 g/cm. Note that the pressing force here means a pressure per centimeter measured along a direction parallel to a central shaft of the developing roll 11. If the pressing force is set to be less than 100 g/cm, the toner aggregate passes under the pressing force such that it is not sheared into a sufficiently thin layer due to the small blocking force (i.e., a pressure for blocking passage of the toner under the pressing force) by the metal plate 13. For this reason, a thickness of the thin toner layer formed on the surface of the developing roll 11 is increased. As a result, although the copy density is also increased, noncharged toner particles which are not subjected to frictional charge are also increased, thereby causing a fog. On the other hand, when the pressing force exceeds 2,500 g/cm, the thin toner layer becomes extremely thin and a sufficient copy density cannot be obtained.

The metal plate 13 uses a phosphor bronze plate, but a stainless steel plate can be used instead of the phosphor bronze plate. When the phosphor bronze plate is selected among these coating member materials, a thickness thereof is preferably set to be 0.1 to 0.4 mm in order to form a thin toner layer having a proper thickness. If the thickness of the metal plate 13 is less than 0.1 mm, a bending modulus becomes small. Then, it is difficult to form a thin toner layer having a proper thickness. On the other hand, if the thickness of the metal plate 13 exceeds 0.4 mm, a nip width between the developing roll 11 and the metal plate 13 is decreased, thereby increasing the pressing force acting per unit area. The toner particles are immediately subjected to a high pressure under the pressing force. Therefore, the toner particles are attached and fused to the surface of the developing roll 11 due to frictional heat. The fused particles result in a nonuniform thin toner layer. Note that at least an end face of the metal plate 13 positioned adjacent to the surface of the developing roll 11 is preferably formed into a curved surface **13*a*** in view of easy assembly.

Furthermore, reference numeral 14 denotes a power source for applying a bias voltage both to the developing roll 11 and the metal plate 13. Reference numeral 15 denotes a selenium photosensitive drum as a latent image carrier which is provided to be opposed at a predetermined distance, for example, 250 μm to the developing roll 11 and is rotated counterclockwise. In addition, reference numeral 16 denotes a toner holder which is provided above the developing roll 11 and feeds nonmagnetic toner 17 to the outer circumferential surface of the developing roll 11.

According to such a construction as described above, when the developing roll 11 is rotated clockwise, the nonmagnetic toner 17 held in the toner holder 16 is fed along the outer circumferential surface of the developing roll 11 under the pressing force of the metal plate 13 having elasticity as the flexible coating member. In this case, the metal plate 13 has a large modulus of elasticity in comparison to that of a rubber plate and has a small deformation amount with respect to the pressure caused by fixing jigs and the like. In addition, the metal plate 13 has a small plastic deformation amount and a curved outer portion thereof is in contact with the outer circumferential surface of the devloping roll 11. For this reason, the pressing force of the metal plate 13 acting on the developing roll 11 becomes uniform, thereby forming a thin toner layer having a uniform thickness. Furthermore, by constructing the flexible coating member using a metal plate, when the toner 17 is pressed by the metal plate 13, the surface of the metal plate 13 cannot be charged up by continuous friction with the toner 17. Therefore, since the toner charge and a shear force acting on the toner aggregate always becomes constant, the thin toner layer having a constant charge and a uniform thickness can be stably formed.

Since the roughened surface 12 is formed on the surface of the developing roll 11, friction between the toner 17 and the developing roll 11 is increased. Then, a toner aggregate 18 can be sheared without slippage with respect to the surface of the developing roll 11, as shown in FIG. 5, thereby forming the thin toner layer in which the toner particles 17 are density aligned on the surface of the developing roll 11. In other words, the thin toner layer is formed by repeatedly shearing the toner aggregate 18 under a blocking force F1 of the metal plate 13 and a feeding force F2 of the developing roll 11. When the smoothness of the surface of the developing roll 11 is high, the slippage occurs between the toner aggregate 18 and the surface of the developing roll 11, and the toner aggregate 18 is gathered under the pressing force of the metal plate 13. As a result, further toner particles cannot pass this position, thereby forming stripes in the thin toner layer. When the toner having a strong self aggregation property is used, such tendency is considerable. Therefore, since the roughened surface 12 is formed on the surface of the developing roll 11, the slippage between the toner aggregate 18 and the developing roll 11 can be prevented, thereby forming a uniform thin toner layer regardless of the self aggregation of the toner.

In order to prevent a fog, when the thin toner layer is formed, the power source 14 supplies a bias voltage to the metal plate 13 as well as the developing roll 11, thereby short-circuiting them. Therefore, the surface of the metal plate 13 cannot be charged by friction.

The photosensitive drum 15 is arranged to oppose the developing roll 11 having the thin toner layer thereon. When the thin toner layer on the roll 11 is adjacent to a latent image formed on the drum 15 upon rotation of the drum 15, the negatively charged toner particles 17 are applied to the latent image through a gap, thereby forming a developed image.

Since a metal plate is used as the flexible coating member and is arranged to be brought into surface contact with the developing roll 11 except for the end face thereof, the thin toner layer having a uniform thickness can be stably formed and a high quality developed image having a constant copy density can be obtained with high reproducibility. Particularly, since the phosphor bronze plate having a large elastic limit is used as the metal plate, the constant pressing force can be obtained and the plastic deformation can be prevented, thereby obtaining a developed image having a constant copy density. Furthermore, since the roughened surface 12 is formed on the surface of the developing roll 11, toner density on the surface of the developing roll 11 can be increased, thereby obtaining a devloped image having a high copy density.

When the toner aggregate is under the pressing force of the metal plate 13, the toner aggregate is destroyed by the large frictional force between the roughened surface 12 of the developing roll 11 and the metal plate 13. For this reason, no toner particle is clogged under the pressing force of the metal plate 13, thereby constantly forming a uniform thin toner layer. When a foreign material is inserted under the pressing force of the metal plate 13, the uniform thin toner layer can be formed by the same destroy and feeding effects as described above.

Furthermore, since the free end portion of the metal plate 13 is not in contact with the developing roll 11 and the surface thereof, the developing apparatus according to this embodiment can have a satisfactory effect same as that of the prior art. Furthermore, since the surface of the metal plate 13 except for the free end portion is arranged to be in contact with the developing roll 11 having the roughened surface 12, the uniform thin toner layer can be stably formed without losing a thickness adjusting function of the thin toner layer by the metal plate 13.

In other words, if the free end portion of the metal plate 13 is arranged to be in contact with the developing roll 11 having the roughened surface 12, the free end portion thereof is considerably worn in comparison with the case wherein a developing roll having no roughened surface 12 is used. For this reason, the thickness adjusting function of the metal plate 13 can be easily changed. Therefore, when the roughened surface 12 is formed on the surface of the developing roll 11 and the surface of the metal plate 13 except for the free end portion is arranged to be in surface contact therewith, the roughened surface 12 of the developing roll 11 can be effectively used.

Furthermore, the relationship among $\mu t$, $\mu b$, and $\mu r$ is set to be:

$$\mu t < \mu b < \mu r$$

where the value $\mu r$ is the friction coefficient between the developing agent carrier and the non-magnetic developing agent, the value $\mu t$ is the friction coefficient between the particles of the developing agent, and the value $\mu b$ is the friction coefficient between the elastic member and the non-magnetic developing agent.

To form a thin developing agent layer when the non-magnetic developing agent is pressed by the elastic member, (1) a shearing surface must be formed in the layer and (2) the sheared developing agent must not adhere to the surface of the developing agent carrier so strongly that it cannot move out of contact with the elastic member. To satisfy these conditions, sliding movement must be permitted between the elastic member and the developing agent. Therefore, the ineqality $\mu t < \mu b < \mu r$ must obtain.

Still further, the developing apparatus of the present invention has a satisfactory effect in a non-contact developing method. The non-contact developing method has advantages in prevention of a fog and an application for overlapping color development. In the developing apparatus according to the present invention, the thin toner layer is formed on the surface of the developing roll, and is applied to a latent image surface, thereby performing development. For this reason, when the present invention is adopted in a contact type developing apparatus in which a thin toner layer is in contact with a latent image surface to perform development, in order to prevent damage to a photosensitive body due to contact with a developing roll, setting of the positions of the roll and the photosensitive body requires a high mechanical precision. Therefore, a gap between the developing roll and the photosensitive body must be more than a thickness of the thin toner layer. In other words, when a thickness of the thin toner layer is regulated to be less than the above-mentioned gap, many effects of preventing damage to the photosensitive body and formation of a fog, and of an application in overlapping color development can be obtained.

The developing roll 11 which is supported as the movable developing agent carrier so as to be rotatable clockwise is made of aluminum and has a diameter of 40 mm. The surface of the developing roll 11 has the roughened surface 12 having a JIS 10-point average roughness of 4 μm by a sandblast treatment. Note that the phosphor bronze plate 13 having a thickness of 0.2 mm is used as the flexible coating member. The outer surface except for its free end portion of the phosphor bronze plate 13 is urged against the outer circumferential surface of the developing roll 11. The selenium photosensitive drum 15 is used as the latent image carrier. Furthermore, particles of an average diameter of 14 μm which contain polystyrene, carbon, a charging control agent, and the like are used as the nonmagnetic toner particles 17 held in the toner holder 16.

In the developing apparatus having the abovementioned construction, when the developing roll 11 was rotated clockwise, a thin toner layer was formed on the surface of the developing roll 11. When the thus obtained thin toner layer was subjected to noncontact development with respect to the photosensitive drum 15 which is arranged to oppose the developing roll 11, the relationship between the pressing force of the phosphor bronze plate 13, the image density and a fog density shown in FIG. 6 was found. Note that a maximum value of a surface potential of the photosensitive drum 15 was 800 V, a voltage from the power source 14 was 100 V, a gap between the developing roll 11 and the photosensitive drum 15 was 250 μm, and a peripheral velocity of the developing roll 11 and the photosensitive drum 15 was 100 mm/sec. Assume that criteria for a good/bad image are an image density of 1.0 or more and a fog density of 0.1 or less. As is apparent from FIG. 6, when the pressing force of the phosphor bronze plate 13 falls in the range between 100 g/cm and 2,500 g/cm, a satisfactorily good image can be obtained.

When the developing operations were performed using phosphor bronze plates having a thickness of 0.05 mm, 0.1 mm, 0.4 mm, and 0.5 mm, respectively, the phosphor bronze plate of a thickness of 0.05 mm had a fog density of 0.2, the phosphor bronze plate of a thickness of 0.5 mm had an image density of 0.6, and the phosphor bronze plates of a thickness of 0.1 to 0.4 mm provided good images.

When the roughness of the roughened surface 12 of the surface of the developing roll 11 is 0.07 to 1.5 times of the average diameter of the toner particle, an effect of the roughened surface 12 becomes considerable. When the roughenss is 0.07 times or less of the average diameter of the toner particle, friction between the toner and the surface of the developing roll 11 cannot become a satisfactory value, and it is difficult to form a uniform thin toner layer. On the other hand, when the roughness of the roughened surface 12 exceeds 1.5 times of the average diameter of the toner particles, a good thin toner layer can be formed, but the following problems also occur. First, a difference between a thickness of the thin toner layer formed on a projecting portion of the surface and that formed on a recessed portion thereof becomes extremely large, resulting in a low resolution of the obtained image. Second, it is difficult to transfer toner particles inserted in the recessed portion to a latent image, and such toner particles collect in the recessed portion. For this reason, the surface of the developing roll 11 is covered with the collected toner particles, and further toner particles cannot be brought into contact with the surface of the developing roll 11. As a result, the number of noncharged toner particles which are not subjected to frictional charge is increased, resulting in a fog and a low image density.

Figure 7:
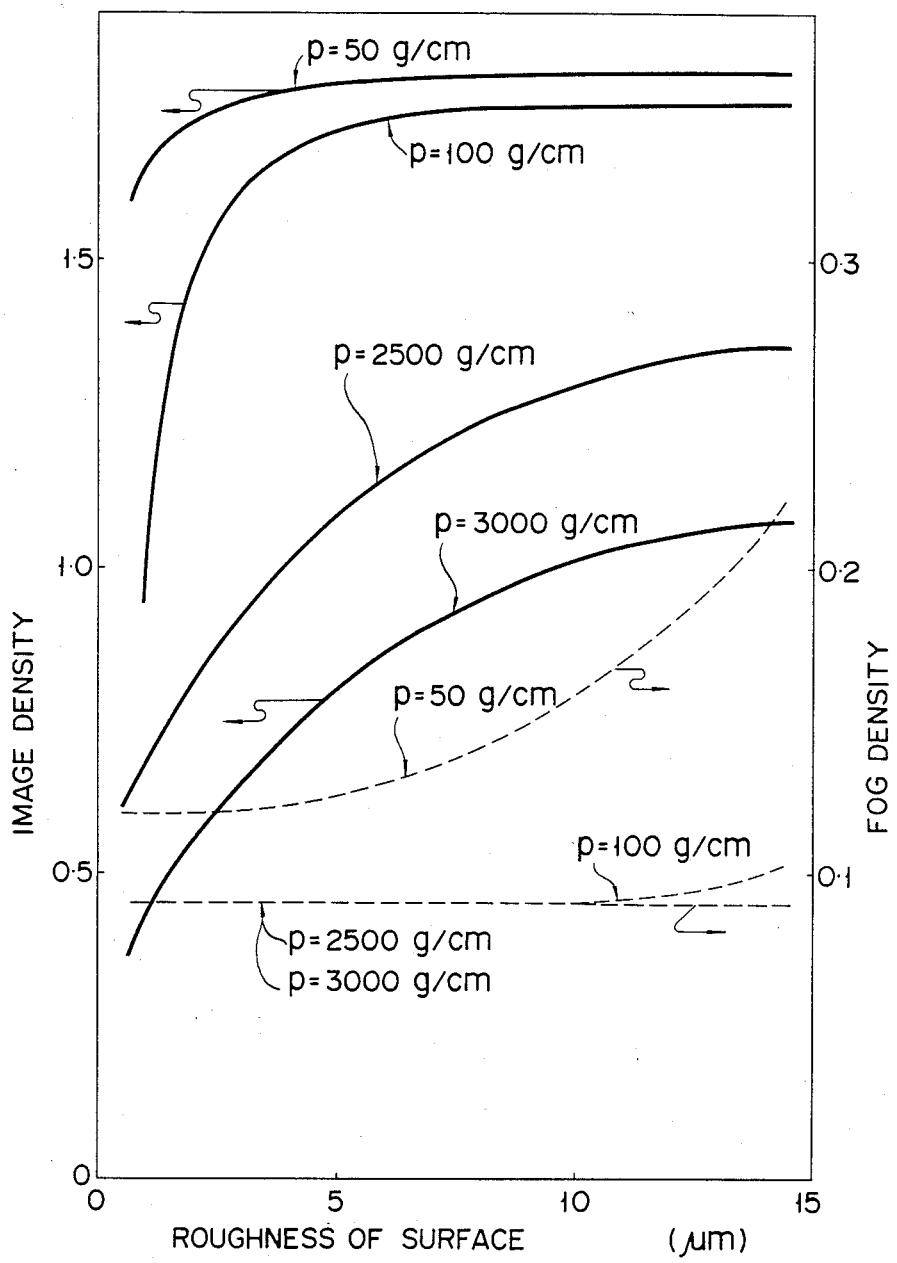
FIG. 7 is a chart showing the relationship of the roughness of the surface of the developing roll to the image density and the fog density in the apparatus of FIG. 4.

In the developing apparatus shown in FIG. 4, when the non-contact development was performed using developing rolls 11 respectively having roughened surfaces 12 of JIS 10-point average surface roughness (JIS-BO601) of 0.5 μm, 1 μm, 10 μm, 21 μm and 28 μm, the relationship between the image density, the fog density, and the roughness of the roughened surfaces 12 of the developing rolls 11 shown in FIG. 7 was found.

Assume that the criteria of a good/bad image are an image density of 1.0 or more and a fog density of 1.0 or less. As is apparent from FIG. 7, a satisfactory image can be obtained when the roughness of the roughened surface 12 is 1 μm to 24 μm. Since the average diameter of the toner particle is 14 μm, the proper roughness of the roughened surface 12 falls within the range between 0.07 to 1.0 times the average diameter of the toner particle.

When the roughened surface 12 is formed on the surface of the developing roll 11 by the sandblast treatment, it can be formed with high reproducibility. In the sandblast treatment, an abrasive is blown against the surface of the developing roll 11, thereby forming a roughened surface thereon. According to this treatment, the surface roughness can be controlled and good reproducibility can be provided, thus allowing mass-production. Since a shape of the roughened surface has no regularity, the developed image (copied image) having a uniform quality can be obtained.

Furthermore, when the continuous copying operation was performed under the optimum conditions as described above, images having a satisfactory quality could be obtained after 5,000 copies and no attachment of the toner particles on the surface of the developing roll 11 could be found.

The present invention is not limited to the construction of the above embodiment, and various changes and modifications may be made within the spirit and scope of the present invention.

For example, the roughened surface 12 of the developing roll 11 can be hard-plated. According to this hard plating treatment, mechanical wear of the surface of the developing roll 11 under the pressing force of the metal plate can be sufficiently reduced. It should be noted that the wear of the surface of the developing roll 11 allows changes in the surface roughness, resulting in changes in the thickness of the thin toner layer and changes in the copy density. This hard plating treatment allows prolonging of the life of the developing roll 11. For example, development was repeatedly performed using a developing roll 11 formed of aluminum having a surface roughness of 4 μm formed by the sandblast treatment, and another developing roll 11 whose surface was coated with a hard chromium plating layer having a thickness of 5 μm to have a final surface roughness of 4 μm after the sandblast treatment. The worn state of the projecting portions of the surfaces of the respective developing rolls was measured. After production of 5,000 copies, the surface roughness of the former developing roll was decreased from 4 μm to 2 μm, but that of the latter developing roll did not change at all. When the developing roll on which no hard chromium plating was performed was used, the copy density was also decreased in accordance with changes in the surface roughness. In the initial state, the copy density was 1.3, but after production of 5,000 copies it was decreased to 1.1. When a developing roll on which the hard chromium plating was performed was used, no change in the copy density could be found. In this manner, when the hard chromium plating is performed on the surface of the developing roll, the stability of the development is increased and the life of the developing roll is considerably increased.

Figure 8:
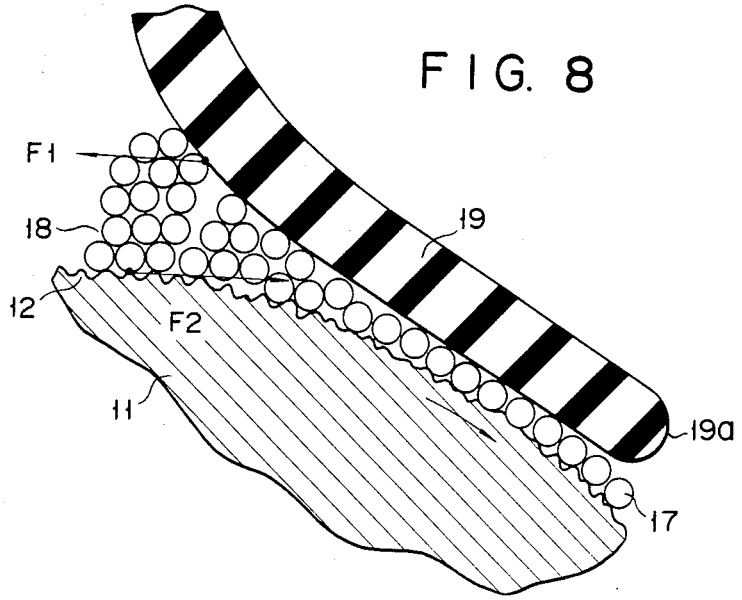
FIG. 8 is an enlarged sectional view showing a contact area between the developing roll and the elastic blade of the other embodiment.
Figure 9:
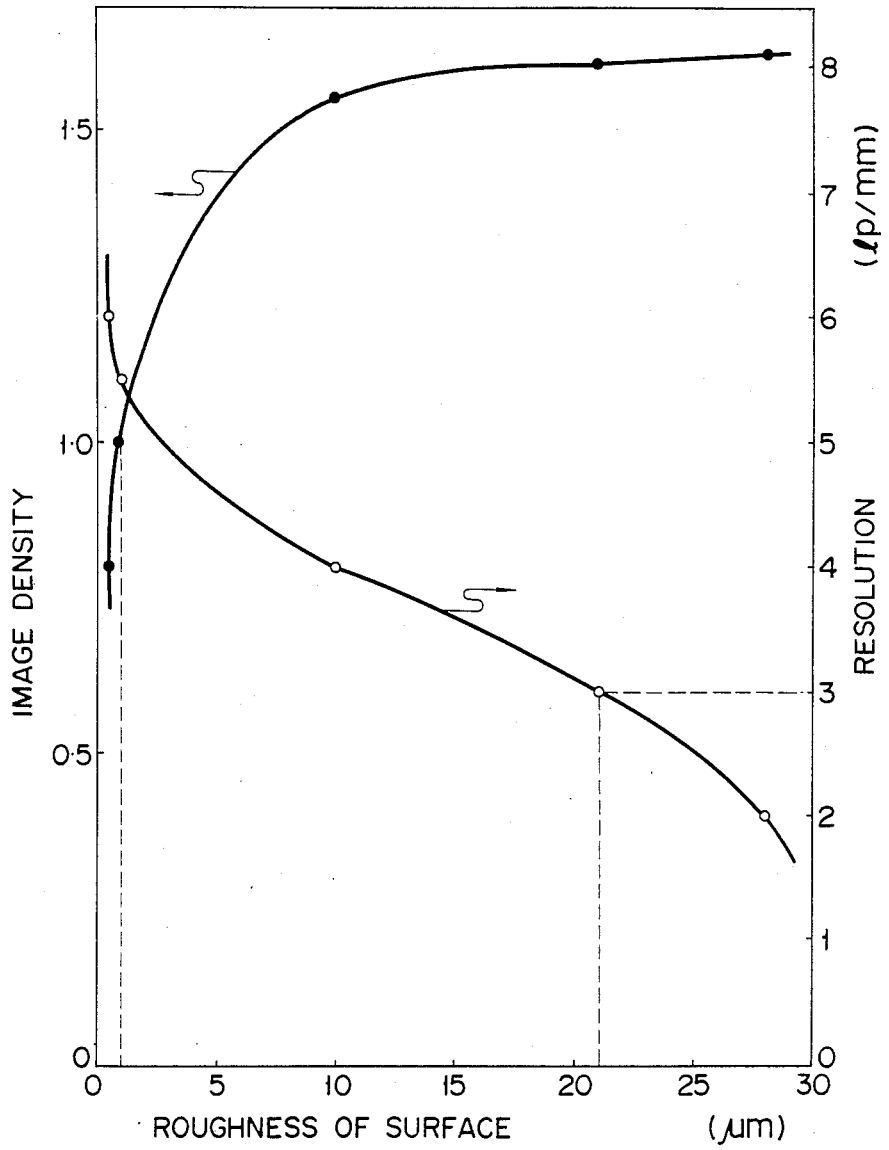
FIG. 9 is a chart showing the relationship of a roughness of the surface of the developing roll to the image density and to a resolution.

In the above embodiment, a metal plate, particularly, a phosphor bronze plate is used as a flexible coating member. However, the flexible coating member is not limited to this, but any plate having elasticity can be adopted. For example, as shown in FIG. 8 as another embodiment, an elastic blade 19, more particularly, a urethane rubber blade can be used instead of the metal plate. Note that the urethane rubber blade 19 has a hardness of 30 and a thickness of 2 mm. In the developing apparatus using this urethane rubber blade 19, the surface roughness of a roughened surface of a developing roll 11 was varied, and the resultant copy density and resolution were measured. The result from this test is shown in FIG. 9. Assume that criteria of a good/bad image are an image density of 1.0 or more and a resolution of 3.0 or more. When the roughness of the surface falls within the range between 1 μm to 21 μm, a good image can be obtained. Since the average diameter of the toner particles is 14 μm, the proper surface roughness becomes 0.07 to 1.5 times the average diameter of the toner particles.

As described above, according to the present invention, a developing apparatus which can uniformly form a high quality image having a sufficient copy density by using a one-component developing agent consisting of nonmagnetic toner can be obtained, and a compact, light-weight, low-price image forming apparatus such as a copying machine which adopts this developing apparatus can be effetively provided.

What is claimed is:

1. A developing apparatus for developing a latent image formed on an image carrier by a non-magnetic developing agent consisting essentially of non-magnetic particles, said developing apparatus comprising:

(a) an image carrier;

(b) a developing agent carrier for carrying the non-magnetic developing agent thereon in the form of a layer, said developing agent carrier being disposed apart from said image carrier by a prescribed distance; and (c) an elastic metal member formed of a metallic material and pressed against the surface of said developing agent carrier to apply the non-magnetic developing agent thereto, so that the non-magnetic developing agent is applied to the surface of said developing agent carrier by said elastic metal member to form a thin layer of the non-magnetic developing agent on the surface of said developing agent carrier;

(d) the thin layer of the non-magnetic developing agent being opposed to said image carrier to deposit the non-magnetic developing agent on the latent image on said image carrier, thereby developing the latent image;

(e) the thickness of the thin layer of the non-magnetic developing agent being smaller than the prescribed distance;

(f) said developing agent carrier having a surface which is opposed to said image carrier and the whole of which is roughened;

(g) said developing agent carrier being electrically connected to said elastic metal member;

(h) the relation among μt, μb, and μr is:

$$\mu t < \mu b < \mu r$$

where the value μr is the friction coefficient between said developing agent carrier and the non-magnetic developing agent, the value μt is the friction coefficient between the particles of the developing agent, and the value μb is the friction coefficient between said elastic metal member and the non-magnetic developing agent.

2. The developing apparatus according to claim 1, wherein said elastic metal member is formed of a thin metal blade.

3. The developing apparatus according to claim 2, wherein said thin metal blade is made of phosphor bronze.

4. The developing apparatus according to claim 3, wherein the surface roughness of said developing agent carrier is 0.07 to 1.0 times the average diameter of the particles of the non-magnetic developing agent.

5. The developing apparatus according to claim 4, wherein said thin metal blade is pressed against said developing agent carrier at a pressing force of 100 g/cm to 2,500 g/cm.

6. The developing apparatus according to claim 4. wherein said thin metal blade has a thickness of 0.1 to 0.4 mm.

7. The developing apparatus according to claim 1, wherein said developing agent carrier has a hard layer which is formed on the roughened surface thereof by a hard-plating treatment.

8. The developing apparatus according to claim 1 wherein said developing agent carrier is electrically connected to said elastic metal member by a power source which applies a bias voltage to said developing agent carrier.

9. The developing apparatus according to claim 1, wherein at least one end face of said elastic metal member positioned adjacent to the working surface of said developing agent carrier has a moderately curved surface formed by polishing.

10. The developing apparatus according to claim 1, wherein the working surface of said elastic metal member except for the free end portion thereof is brought into surface contact with the working surface of said developing agent carrier.

11. Apparatus for developing a latent image formed on an image carrier using a non-magnetic developing agent consisting essentially of non-magnetic particles, said apparatus comprising:

(a) an image carrier;

(b) a developing roll which is rotatable about a central axis and which has a roughened circumferential working surface, the roughened circumferential working surface of said developing roll and said image carrier being spaced apart by a prescribed distance;

(c) an elastic metal member having a smooth working surface pressed tangentially against the roughened cirumferential working surface of said developing roll by a prescribed force, the smooth working surface of said elastic metal member and the roughened circumferential working surface of said developing roll defining a metering nip for a non-magnetic developing agent sized, shaped, and positioned to allow a thin layer of the non-magnetic developing agent to pass therethrough to coat the roughened circumferential working surface of said developing roll, the thickness of the thin layer of the non-magnetic developing agent being less than the prescribed distance between the roughened circumferential working surface of said developing roll and said image carrier;

(d) means for feeding the non-magnetic developing agent to said metering nip; and (e) means for applying a bias voltage both to said developing roll and to said elastic metal member, thereby preventing the smooth working surface of said elastic metal member from being charged by friction, (f) wherein the roughness of the roughened circumferential working surface of said developing roll and the roughness of the smooth working surface of said elastic metal member are such that:

$$\mu t < \mu b < \mu r$$

wherein $\mu r$ is the coefficient of friction between the roughened circumferential working surface of said developing roll and the particles of the non-magnetic developing agent, $\mu t$ is the coefficient of friction between the particles of the non-magnetic developing agent, and $\mu b$ is the coefficient of friction between the particles of the non-magnetic developing agent and the smooth working surface of said elastic metal member.

* * * * *